US007322868B2

(12) United States Patent
Ross

(10) Patent No.: US 7,322,868 B2
(45) Date of Patent: Jan. 29, 2008

(54) WATER DEVICES AND METHODS FOR MAKING AND USING SUCH DEVICES

(76) Inventor: Jennifer D. Ross, 11731 Twin Ridge Dr., Draper, UT (US) 84020

( * ) Notice: Subject to any disclaimer, the term of this patent is extended or adjusted under 35 U.S.C. 154(b) by 64 days.

(21) Appl. No.: 10/916,076

(22) Filed: Aug. 11, 2004

(65) Prior Publication Data

US 2005/0106963 A1 May 19, 2005

Related U.S. Application Data

(60) Provisional application No. 60/523,344, filed on Nov. 19, 2003.

(51) Int. Cl.
*B63B 35/74* (2006.01)
*B63B 35/78* (2006.01)

(52) U.S. Cl. ..... 441/130; 441/132

(58) Field of Classification Search ..... 441/129–132, 441/135; 114/345, 352–354, 361, 364
See application file for complete search history.

(56) References Cited

U.S. PATENT DOCUMENTS

| | | | | | |
|---|---|---|---|---|---|
| 1,503,624 | A | * | 8/1924 | Bauman et al. | 441/132 |
| 3,074,084 | A | * | 1/1963 | Bisch | 441/131 |
| 4,557,210 | A | * | 12/1985 | Gerwin | 114/61.23 |
| 4,694,770 | A | * | 9/1987 | Kitner et al. | 114/123 |
| 4,934,301 | A | * | 6/1990 | Harding | 114/345 |
| 5,184,564 | A | * | 2/1993 | Robbins et al. | 114/345 |
| 5,520,561 | A | | 5/1996 | Langenohl | 441/129 |
| 5,562,514 | A | | 10/1996 | Rowe | 441/130 |
| 5,571,036 | A | | 11/1996 | Hannigan | 441/129 |
| 5,651,328 | A | * | 7/1997 | Elkington | 114/345 |
| 5,667,416 | A | * | 9/1997 | Barth | 441/130 |
| 5,885,123 | A | | 3/1999 | Clifford | 441/129 |
| 6,213,832 | B1 | | 4/2001 | Fest, Sr. | 441/129 |
| 6,276,979 | B1 | | 8/2001 | Saltel et al. | 441/132 |
| 6,347,971 | B1 | | 2/2002 | Berke et al. | 441/129 |
| 6,371,040 | B1 | * | 4/2002 | Hemphill et al. | 114/219 |
| 2004/0139904 | A1 | * | 7/2004 | Mears | 114/219 |

FOREIGN PATENT DOCUMENTS

| | | | | |
|---|---|---|---|---|
| EP | 26721 | A | * | 4/1981 |
| EP | 102006 | A | * | 3/1984 |
| EP | 703140 | A1 | * | 3/1996 |
| GB | 2196717 | A | * | 5/1988 |
| JP | 2001204350 | A | * | 7/2001 |
| JP | 2003118676 | A | * | 4/2003 |
| WO | WO 9400334 | A1 | * | 1/1994 |

* cited by examiner

*Primary Examiner*—Ajay Vasudeva

(57) ABSTRACT

Water devices and methods for making and using such devices are described. The devices contain a main part for buoying a user's body and a part for supporting the body. The supporting part is releasably connected to the main part by a mechanism which is easily adjusted when not in use but remains fixed when in use. The device also can contain a handle for the user. These devices can be used in all areas of the water, including swimming, exercise, instructional, recreational, and the like.

18 Claims, 11 Drawing Sheets

WATER DEVICES AND METHODS FOR MAKING AND USING SUCH DEVICES

CROSS-REFERENCE TO RELATED APPLICATION

This application claims priority of U.S. patent application Ser. No. 60/523,344, filed Nov. 19, 2003, the entire disclosure of which is incorporated herein by reference.

FIELD OF THE INVENTION

The invention generally relates to water devices and methods for fabricating and using such devices in the water. More particularly, the invention relates to water devices containing foam tubes and methods for fabricating and using such devices for recreational, exercise, or instructional purposes in the water.

BACKGROUND OF THE INVENTION

There are numerous devices available that are used in the water, such as for swimming. See, for example, U.S. Pat. Nos. 5,634,834, 6,083,067, 6,435,927, 6,620,010, and the references cited therein, the disclosures of which are incorporated herein by reference. Some of these devices can be used for competitive swimming (i.e., pullbuoys), some of the devices can be used for recreational swimming (i.e., floating tubes), and others can be used in instructional swimming (i.e., kickboards). One common characteristic of many such swimming devices is that the device supports a part of the body and helps it to float.

Many of the known swimming devices, however, suffer from some important drawbacks. For example, one common limitation with some swimming devices is that they do not allow a user's face to be placed in the water during operation (which can be helpful in basic swimming instruction). As well, many of the swimming devices that are used as teaching aids are really not an aid, but when used can turn out to be a crutch. In this example, kickboards are often used as a floating aid while teaching a person to swim, but do not allow for the face to be placed in the water. Unfortunately, the person learns to float with the kickboard and this can detract from the ability of the individual to learn to float (and swim) without this floating aid.

As well, many of the known swimming devices are awkward to use and are limited to a single use. For example, kickboards can be difficult and awkward to used, especially for novice swimmers or those learning to swim. In another example, float tubes (and pullbuoys) are generally limited in their uses, i.e., a limited amount of support for only a single part of the body (i.e., arms for the float tubes and legs for pullbuoys).

There are also water devices that are used for floating and other recreational uses. See, for example, U.S. Pat. Nos. 6,347,971 and 6,213,832, the disclosures of which are incorporated herein by reference. Many of such devices use a foam tube known as a WATER NOODLE that is bent into various shapes (such as a chair) and a supporting mechanism for the body is added. See, for example, U.S. Pat. Nos. 5,520,561, 5,571,036, 5,885,123, and 6,276,979, and the patents cited therein, the disclosures of which are incorporated herein by reference.

The supporting mechanism in these devices often contains a sleeve around the foam tube. Such sleeves provide the advantage of being easy assembled and easily adjustable lengthwise along the device, but not allow for adjustment widthwise. As well, the sleeves are prone to slip easily. When the sleeve slips, it typically does not provide the desired support function for the user. As well, these devices are primarily used for recreational and floating uses, and can be very difficult to use for exercise or instructional uses.

SUMMARY OF THE INVENTION

The invention includes water devices and methods for making and using such devices. The devices contain a main part for buoying a user's body and a part for supporting the body. The supporting part is releasably connected to the main part by a mechanism which is easily adjusted when not in use but remains fixed when in use. The device also can contain a handle for the user. These devices can be used in all areas of the water, including swimming, exercise, instructional, recreational, and the like.

BRIEF DESCRIPTION OF THE DRAWINGS

The following description of the invention can be understood in light of FIGS. 1-5, 6A, 6B, 7A, 7B, 8A, and 8B, and 9-13 which depict various aspects of the invention.

FIGS. 1-5, 6A, 6B, 7A, 7B, 8A, and 8B, and 9-13 illustrate specific aspects of the invention and are a part of the specification. Together with the following description, the Figures demonstrate and explain the principles of the invention. The Figures presented in conjunction with this description are views of only particular—rather than complete—portions of the invention. In the Figures, the physical dimensions may be exaggerated for clarity. The same reference numerals in different drawings represent the same element, and thus their descriptions will be omitted.

DETAILED DESCRIPTION OF THE INVENTION

The following description provides specific details in order to provide a thorough understanding of the invention. The skilled artisan, however, would understand that the invention can be practiced without employing these specific details. Indeed, the invention can be practiced by modifying the illustrated method and resulting product and can be used in conjunction with apparatus and techniques conventionally used in the industry. The invention described below deals primarily with using the device for instructional swimming. The invention, however, could be modified for any use in the water, such as water sports (like water polo), recreational, water aerobics, floating, boating, personal watercraft, snorkeling, and the like.

As described above, the invention includes water devices that are used for buoying or supporting a person in the water. The devices contain a main portion for buoying the person's body (i.e., the upper portion) and a supplemental portion for supporting the user, i.e., the middle and/or lower portion of the body. The supporting portion is releasably connected to the main portion by a mechanism which is easily adjusted when not in use but remains fixed when in use. Any device containing these two portions connect in this manner can be used in the invention, including the devices illustrated in that aspect of the invention shown in the Figures.

Figure 1:
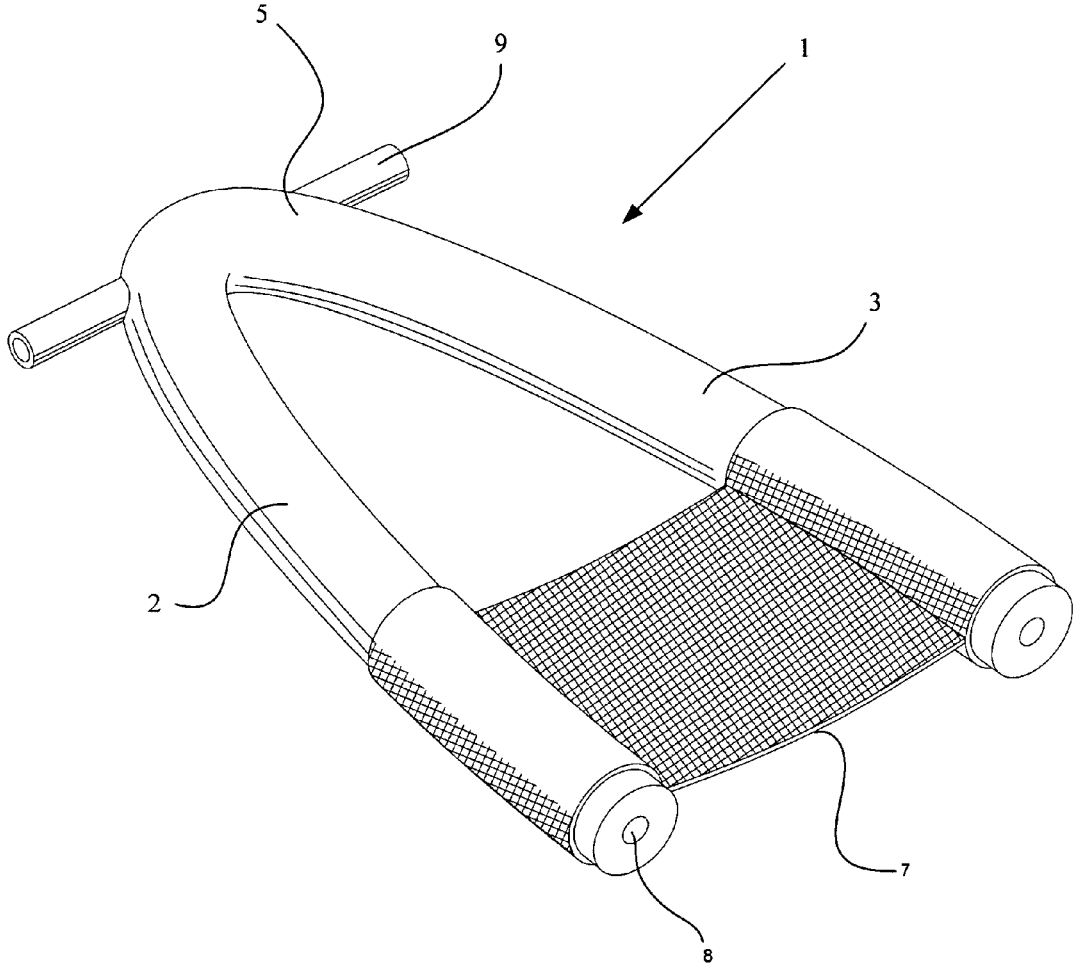
FIG. 1 illustrates the device in one aspect of the invention.

FIG. 1 depicts the water device 1 in one aspect of the invention. The main portion 5 of the device 1 provides the bulk of the buoyancy function. Thus, the main portion 5 comprises any material that will provide the desired buoyancy for the expected user while exhibiting the needed durability. Generally, the main portion 5 can be made of any known material with a density less than water, such as inflatable materials or foamed plastic materials. In one aspect of the invention, foamed plastic materials like polystyrene or polyethylene are used for the main portion. In another aspect of the invention, ETHAFOAM (the closed cell foam manufactured by Dow Chemical) or other closed cell foam that can provide positive flotation can be used as the material for the main portion. The elongate portion can be made of a solid material or can contain a hollow core. The elongate portion could be manufactured with a core or the core could be created after manufacture.

The main portion 5 comprises two elongate portions 2 and 3. In one aspect of the invention, the main portion is made by bending a "float tube" (like the WATER NOODLE) into the two elongate portions 2 and 3 as depicted in FIG. 1. Bending the float tube in the manner creates a generally "u"-shaped configuration as shown in FIG. 1. Such a configuration can be very useful when using the device for floating or recreational activities.

Figure 2:
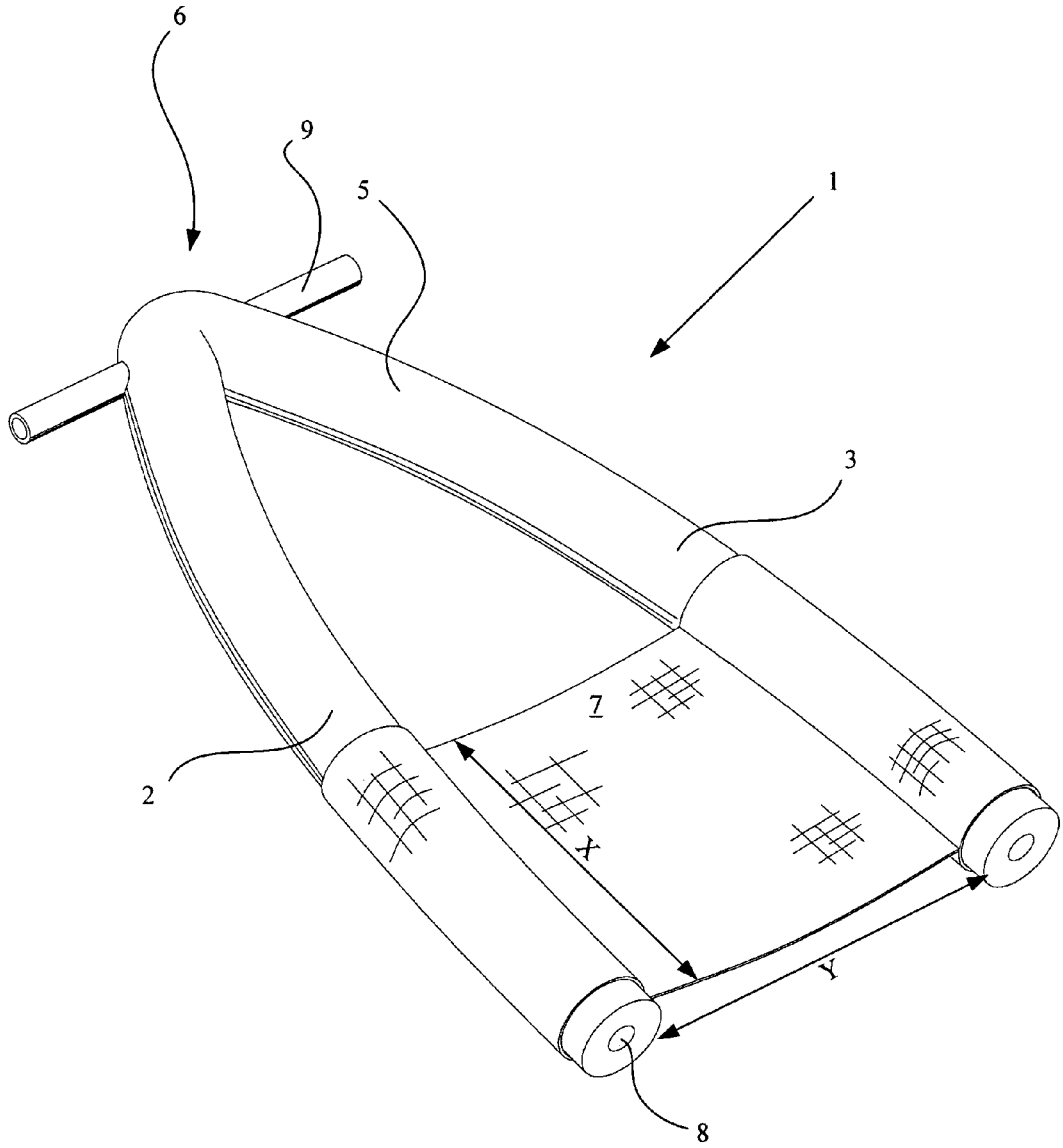
FIG. 2 illustrates the device in another aspect of the invention.

In another aspect of the invention, the main portion 5 comprises an apex 6 and two elongate portions 2 and 3 as depicted in FIG. 2. The apex 6 provides a more hydrodynamic shape for the device 1, which can be very useful in instructional swimming. As well, configuring the main portion with an apex prevents the u-shaped configuration from changing to become a "j"-shaped configuration.

Figure 3:
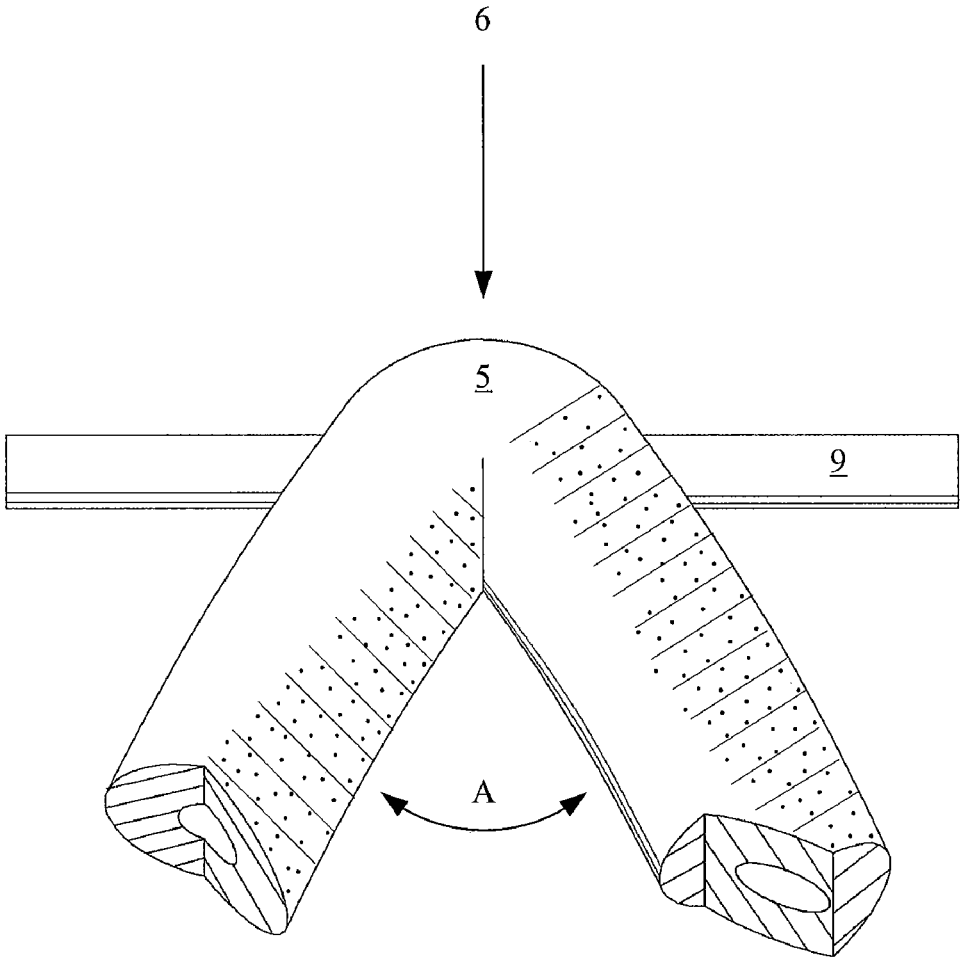
FIG. 3 depicts a close-up of a portion of the device in another aspect of the invention.

The angle A of the apex 6 (as shown in FIG. 3) generally can range from about 70 to about 125 degrees. In one aspect of the invention, the angle of the apex can range from about 80 to about 100 degrees. In another aspect of the invention, the angle of the apex is about 90 degrees.

The apex can be formed in any manner which provides the structure illustrated in FIGS. 2 and 3. In one aspect of the invention, the apex 6 is formed by taking a single foam tube, cutting a portion in the middle on a single side to form a wedge-shaped hole or divot, and then taking the two ends of the foam tube and bending them in the direction of the cut. This action forces the two portions of the foam tube on either side of the wedge-shaped hole to come together. If necessary, a bonding agent can be placed in the wedged-shaped hole so that when the portions of the foam tube are pushed or held together, the bonding agent help keep them together.

In this aspect of the invention, the end of the device has a shape that depends on the depth of the wedged-shaped cut. The deeper the cut and the larger the wedge shape, the more pointed the shape of the "nose" of the device 1.

In another aspect of the invention, the apex 6 is formed by taking two foam tubes. Each of the foam tubes are sliced with matching cuts, such as by a 45 degree angle cut. A bonding agent is then placed on each cut surface and then the tubes are bonded together. In this aspect of the invention, the end of the device has a pronounced pointed shape. Such a configuration can be very useful when using the device 1 for swimming activities because of the hydrodynamics of the apex 6.

The shape of the foam tube can be any that will aid in the buoyancy function of the main portion 5. Generally, the foam tube is cylindrical in shape. Other smooth surface shapes (such as elliptical) can be used in the invention. In fact, even non-smooth surface (such as triangular, square, polygonal, . . . ) shapes can be used in the invention.

The elongate portions 2 and 3 of the main portion 5 of the device 1 can have numerous configurations. In one aspect of the invention, such as when using the apex configuration, the lengths of the two elongate portions 2 and 3 can be substantially the same. In another aspect of the invention, such as when the main portion is u-shaped, the lengths of the two elongate portions need not be substantially the same. In this aspect of the invention, the different lengths can be obtained by adjusting the location of the supporting portion so that one elongate portion is longer than the other, i.e., so that a "j"-shape is created.

The lengths of the elongate portions 2 and 3 need only be sufficient to provide the desired buoyancy for the user and be long enough to attach the supporting portion (as described below). For example, longer lengths would be needed for larger and/heavier users. Generally, the length of the elongate portion can range from about 20 to about 60 inches. In one aspect of the invention, the length of the elongate portions can range from about 29 to about 48 inches.

The width (diameter) of the elongate portions need only be sufficient to provide the desired buoyancy for the user. For example, bigger diameters would be needed for larger and/heavier users. Generally, the diameter of the elongate portion can range from about 2 to about 4 inches. In one aspect of the invention, the diameter of the elongate portions is about 2.5 inches.

Figure 4:
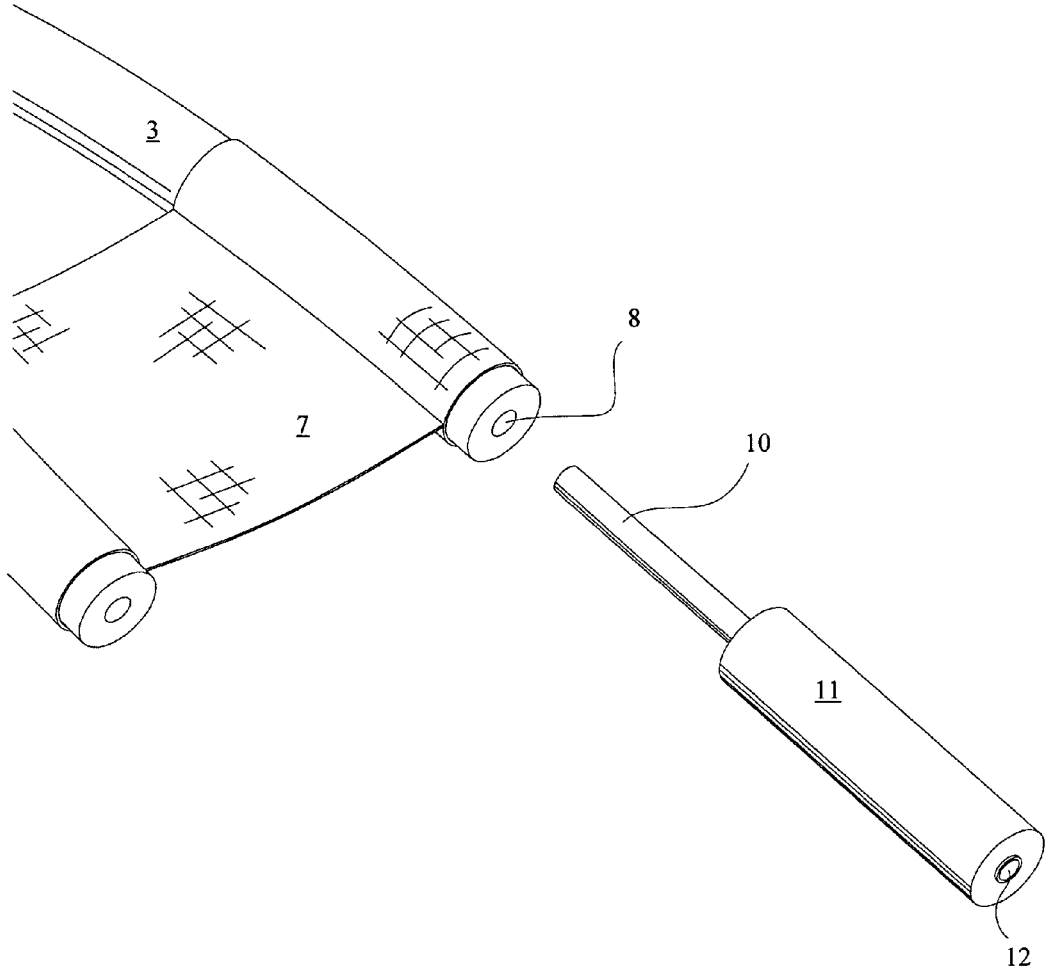
FIG. 4 illustrates a modification that can be made to the device of the invention to extend its length.

In one aspect of the invention, the length of the elongate portions can be modified. For example, the elongate portions could be manufactured relatively long for a taller/heavier user, but could then be shortened by cutting it shorter for a smaller/lighter user. As well, the main portion (including the elongate portions) can optionally be extended to be made longer such as if does not already have the desired length. In this aspect of the invention, the length of the elongate portion(s) can be made longer using extending means as depicted in FIG. 4. The extending means contains one or more discrete sections 11 of substantially the same material as used in the elongate portion, i.e., foam tube. The length of the individual sections 11 in the extending means can range from about 6 to about 12 inches.

The extending means also contain means for connection the discrete sections to the elongate portions or to another discrete section. Any connection means that provides either a temporary or permanent connection can be used in the invention. Examples of such connection means include wrapping a band around the junction of the discrete section and the elongate portion, creating an interlocking wedge system between these two components, and/or the coupling system described below. In one aspect of the invention, a coupler (as described below) is used as the connection means.

Where the elongate portion comprises a foam tube, the coupler comprises a member 10 that fits within the foam tube. Most foam tubes contain a hollow core 8. The member 10 is configured with an outer diameter that is substantially similar to the inner diameter of this hollow inner core 8. The member 10 can be any lightweight, rigid material that is durable in water, such as PVC pipe. To connect the elongate portion with the discrete section(s), the member 10 is first inserted in either the hollow core 8 of the elongate portion or the hollow core of a discrete section (not depicted). Then the discrete section 11 is pushed until it contacts the elongate portion. The discrete section 11 can contain a hollow core 12 as depicted in FIG. 4, or can be solid and thereby operate as a cap.

Generally, the friction created between the outer surface of the member 10 and the inner surface of hollow core 8 is sufficient to retain the connection between the elongate portion 3 and the discrete section 11 during normal use. If not, the diameter of the member 10 can be increased until sufficient friction is created for this purpose. When it is desired to remove the extending means, the user pulls the discrete section 11 and the member 10 from the elongate portion 3.

Where a more permanent connection is desired, a bonding agent can be placed between the member 10 and the elongate portion 3 and/or the discrete section 11. The bonding agent creates a permanent bond between these various components. Any water-resistant bonding agent known in the art can be used, such as thermal glue or contact cement.

The number of extending means used depends on the desired length of extension and the lengths of the various discrete sections. Typically, the number of extending means can be 1 to 5 on either or both elongate portions. In one aspect of the invention, only 1 or 2 extending means are used on either or both elongate portions. Both temporary and permanent connections (either to the elongate portion or to another discrete section) can be used at the same time to obtain the desired configuration of extensions.

The water device 1 of the invention also contains one or more supporting portions. The supporting portion is configured to support the body of a user in the water at any desired location, typically the middle part of the body, i.e., the hips. Using the supporting portion thereby allows the face of a user to be placed or submerged in the water, if desired. The supporting portion also bridges the gap between the elongate portions 2 and 3 of the device. Thus, the supporting portion also operates to hold the shape of the device in the desired position.

Any supporting portion that operates in the above manner can be used in the invention. In one aspect of the invention, the supporting portion 7 illustrated and described below is used in the device 1 of the invention.

As depicted in the Figures, the supporting portion 7 contains a piece of material that is located between the elongate portions 2 and 3. The material of the supporting portion can be any that supports the user and optionally helps the user float. The piece of material can be made of a substantially rigid and lightweight material. In one aspect of the invention, the material should be relatively flat of slightly curved so they are comfortable for the end-user. In another aspect of the invention, the material can be the same or substantially similar to the material as used in the elongate portions. In yet another aspect of the invention, the material is flexible so that they conform to the end user's body.

In this latter aspect of the invention, any flexible material known to be suitable in the water art can be used. Examples of such flexible materials include canvas or nylon. In this aspect of the invention depicted in the Figures, the supporting portion is made of a water resistant mesh material that is lightweight, yet flexible and strong. A polyester mesh material is preferable because of its availability, cost, and resistance to UV light and pool chemicals.

The supporting portion 7 is located along the length of portions 2 and 3 where the expected user will need support. For example, for a child, the supporting portion 7 will be located closer to the forward end of the device than for an adult (where it would be located nearer the rear end). While the supporting portion can be moved along the length of the main portion and is reliably connected thereto as described below, the supporting portion can be permanently affixed to a specific location if desired. This permanent fixation can occur through any mechanism known in the art.

The supporting portion can have various shapes, such as triangular, circular, square, rectangular, oval, elliptical, polygonal, and the like. Typically, the supporting portion has a substantially rectangular shape as illustrated in the Figures.

The size of the supporting portion can be adjusted for various users. Thus, the length of the supporting portion (X) can be adjusted as desired by the user. Generally, the length of the supporting portion can range from about 2 to about 6 inches less than the length of the device, thereby leaving room for a user to place the face in the water. In one aspect of the invention, the length of the supporting portion can range from about 5 to about 10. In yet another aspect of the invention, this length can be about 7 to about 8 inches. In yet another aspect of the invention, the length of the supporting portion can be from one end of the main portion to the other end.

As well, the width of the supporting portion (Y) can be adjusted by the user. Generally, the width of the supporting portion can range from about 6 to about 36 inches. In one aspect of the invention, the width of the supporting portion can range from about 8 to about 24 inches. The largest width possible will depend on the configuration of elongate portions in combination with the supporting portion. As depicted in Figures, the width of supporting portion can extend the whole length of the distance between the elongate portions, or only a portion of that length when a non-sleeve releasable connections means is used (as described below).

The length and width of the supporting portion can be manufactured for a given user. Alternatively, the supporting portion can be manufactured so that the length and/or width is collapsible and/or expandable. To achieve this function, the supporting portion is made to contain Velcro in selected parts. The parts are selected so that when the user folds/compresses the mesh material in a given direction, the Velcro from the selected parts holds the mesh material in the compressed configuration. To expand the supporting portion, the user simply unfolds the material by separating the Velcro. Alternatively, the ends of the supporting portion could be provided with a drawstring that could be tightened to contact the supporting portion.

The supporting portion could be modified to expandable in the following manner. The mesh (or other material) could be manufactured with expandable panel(s) of an elastic material. These panels would expand when the user stretches the supporting portion to connect to the elongate portions and would remain in an expanded condition until the supporting portion is removed from the elongate portions.

The supporting portion is connected to the elongate portions using any suitable connection means. As noted above, the connection means can provide a permanent connection or a temporary connection so that the supporting portion can be moved along the length of the elongate portions. The temporary connection can be provided by any of the releasable connection means described below.

Figure 5:
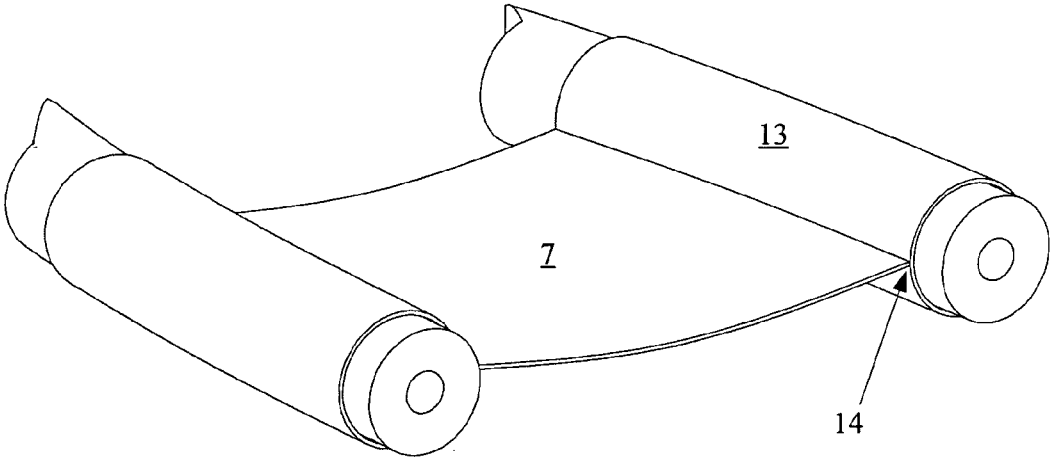
FIG. 5 depicts a releasable connection means that can be used in the device of the invention.

A first releasable connection means comprises a sleeve as depicted in FIG. 5. In this aspect of the invention, each end of the supporting portion is attached to a sleeve 13 that is configured to wrap around the elongate portions. The diameter of the sleeve closely matches the diameter of the elongate portion on which it wraps. Thus, the sleeve can be easily moved up and down the length of the elongate portion. The sleeve 13 is permanently connected to the supporting portion by joint 14, which is usually sewn. While this functionality is quite helpful in some uses of the water device 1, it is not in other uses. In such other uses, the user desires the supporting portion to be adjustable, but remain fixed once adjusted to a given location. This first releasable connection means unfortunately does not exhibit this property by itself: it is adjustable, but does not remain fixed in that location during operation.

Figure 6A:
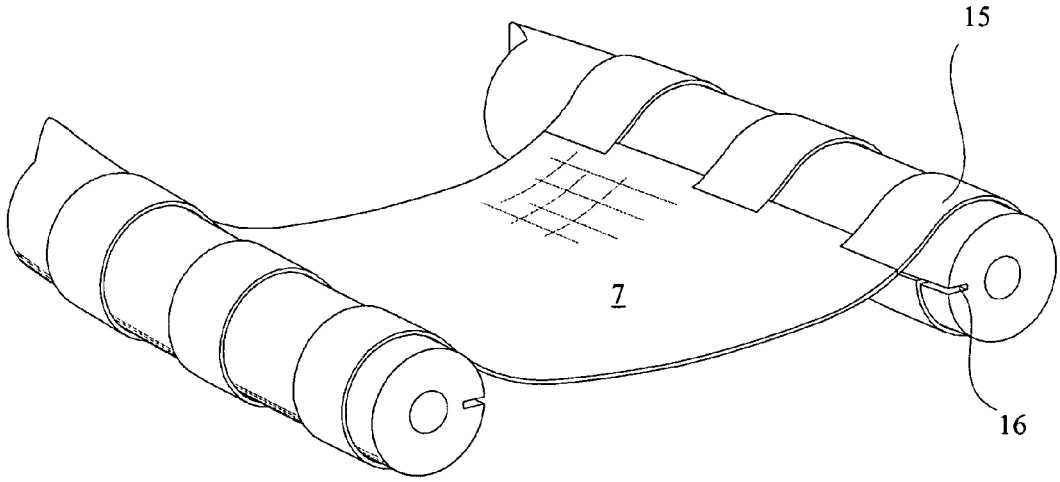
FIGS. 6A and 6B show a top view and a bottom view of another releasable connection means that can be used in the device of the invention.
Figure 6B:
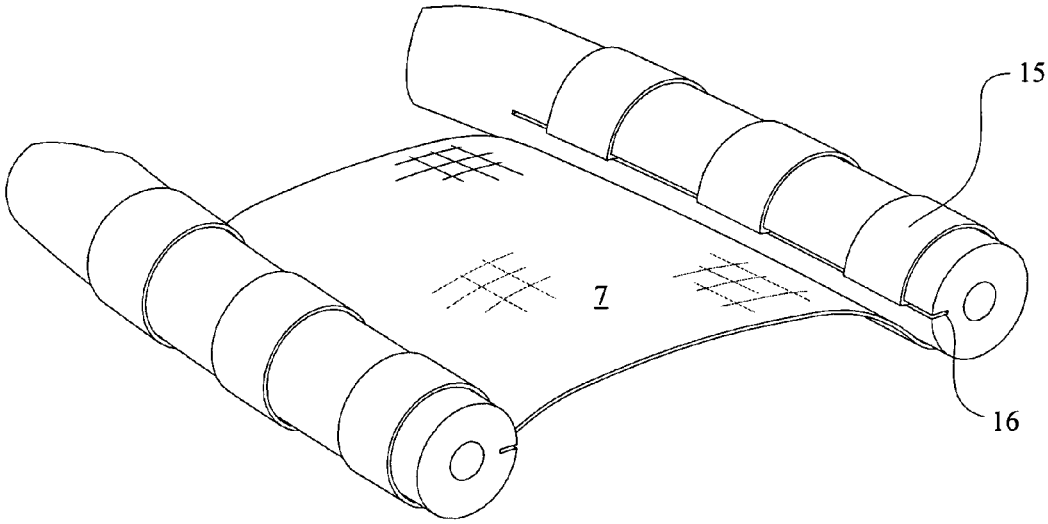

The other releasable connection means exhibit this property of being adjustable, but remaining fixed once adjusted to a given location. The second releasable connection means is depicted in FIG. 6A (top view) and FIG. 6B (bottom view). In this aspect of the invention, a plurality of straps 15 is connected to the supporting portion. Any number of straps can be used to provide the needed connection. Generally, the number of straps can range from 2 to 4 on each side of the supporting portion.

Each strap 15 is releasably attached to the elongate portion in the following manner. A small slit 16 with a size corresponding to each strap is provided in the foam tube of the elongate portion. The inside of the slit is provided with one part of a connector, such as Velcro, hooks, loops, buttons, snaps, posts. The end of each strap 15 is provided with other part of the connector. The strap is then inserted into the slit and the one part of the connector is attached to the other part of the connector. The slit can be provided on any part of the circumference of the foam tube from more than 0 degrees to less than 360 degrees relative to the expected location of the strap. In one aspect of the invention, the slit is provided in a location where the weight of the user will help compress the slit during operation of the device, thereby helping to temporarily secure the supporting portion to the elongate portion.

A third releasable connection means also exhibits this property of being adjustable, but remaining fixed once adjusted to a given location. In this aspect of the invention, a single piece of non-slip material is connected to each end of the supporting means. Alternatively, the single piece of non-slip material can also be used as the supporting means. The material can be a foam-coated polyester mesh that is mold or mildew resistant. As well, the material can be a PVC mesh that provides non-slip strength while allowing air to circulate, thereby suppressing development of molds and odors. In one aspect of the invention, the material comprises a Grip-it® Regular Shelf & Drawer Liner.

This piece of material is then wrapped around the float tube. Because of its nature, the material adheres to the float tube and provides the necessary connection. The degree of adhesiveness depends on the amount of surface contact between this material and the float tube. Thus, the further around the float tube this material is wrapped, the better the adhesiveness (and the better the connection) between the material and the float tube.

The third releasable means can be supplemented by adding a slit in the float tube. In this aspect of the invention, the non-slip piece of this material is wrapped over the top of the float tubes and then inserted into a lengthwise slit that has been created in one or both float tubes. The slit can be created anywhere along the float tube. This configuration has the advantage of creating additional surface area between the float tube and the non-slip material, thereby increasing the adhesion because of the additional surface area. Like other aspect of the invention, using this configuration also creates a "sling" between the foam tubes that acts as the supporting portion.

In fact, the slits as described above can be used without the piece of non-slip material in a fourth releasable connection means. Because of the action of the slits being compressed when the user lays on the sling, a non-slip material can be used instead. In this aspect of the invention, unlike when using the non-slip material, the slits are placed in the foam tube in a location where they are compressed when a user lays on the sling.

Figure 7A:
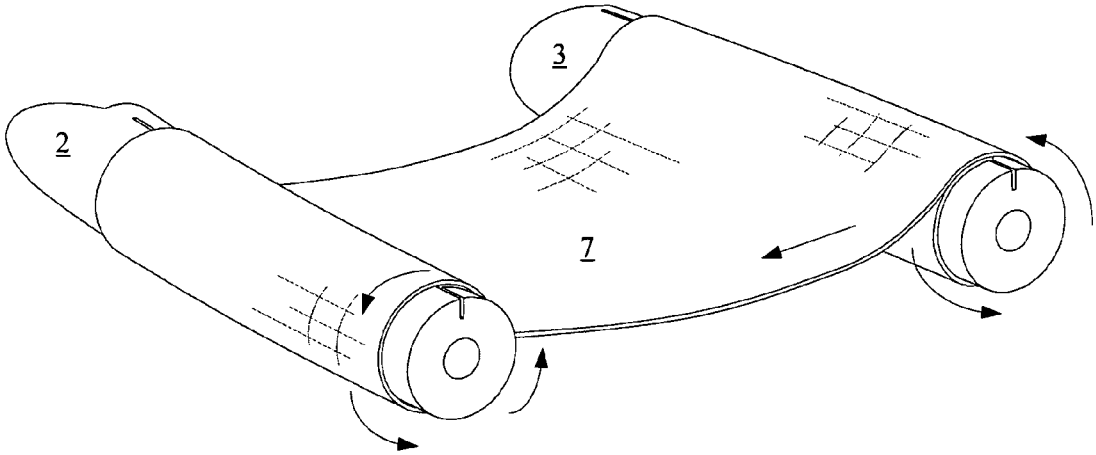
FIGS. 7A and 7B show a top view and a bottom view of another releasable connection means that can be used in the device of the invention.

In one aspect of the invention, this compression occurs when the sling material is inserted in the slit and wrapped around the float tube so that the sling material passes over the slit. In this aspect of the invention, slits 16 are created at or near the top of both float tubes. The single piece of non-slip material is then inserted into in one of the slits, wrapped around the float tube starting with the inner side, bottom, and outer side, then across the top of the float tube and across to top of the other float tube, around the outside, bottom, and inside of the second float tube, and then inserted into the slit in the other float tube. Such a wrapping is depicted in FIG. 7A, with the arrows indicating how the non-slip piece of material is wrapped. The slit can be created anywhere along the top of the float tubes at an angle of about 45 degrees on either side of the immediate top of the float tube. When the user lays on the supporting portion created in this wrapping process, the weight causes the slits to compress and holds the piece of non-slip material in place.

Figure 7B:
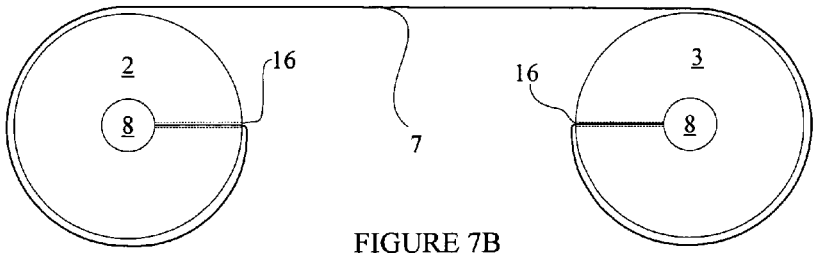

In a similar aspect of the invention, the slits are created on the inner sides of the float tubes. In this aspect, the sling material does not pass back over the slit because it is not necessary for the sling material to go all the way around the tube to create effective connection. The slit can be located at angles ranging from about 45 to about 135 degrees for the left float tube and from about 225 to about 315 degrees on the right float tube (measured relative to the top of the float tube). In one aspect of the invention, the slits are created at about 90 degrees on the left float tube and about 270 degrees on the right float tube (again, assuming the top of the float tube to be 0 degrees). The piece of non-slip material is inserted into one of the float tubes, then wrapped down and across the bottom, over outer side and the top of that float tube, across to the top of the other float tube, over the outer side and across the bottom of the other float tube, and finally into the slit on the inside of the other float tube. Such a wrapping is depicted in FIG. 7B.

In any of these aspects of the invention, the slits can be cut partially or completely through the foam tube. The deeper the cut, the more the friction due to the increased surface area. Cutting too deep, however, can sometime undermine the structural integrity of the foam tube. In one aspect of the invention, the cut is usually made all the way into the core. The slits are also cut lengthwise in the foam tube in sufficient length so that the sling can be moved into the desired location.

Figure 8A:
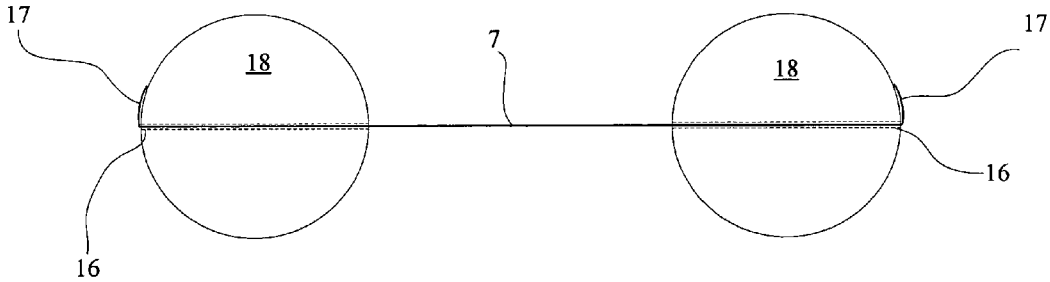
FIGS. 8A and 8B show views of another releasable connection means that can be used in the device of the invention.
Figure 8B:
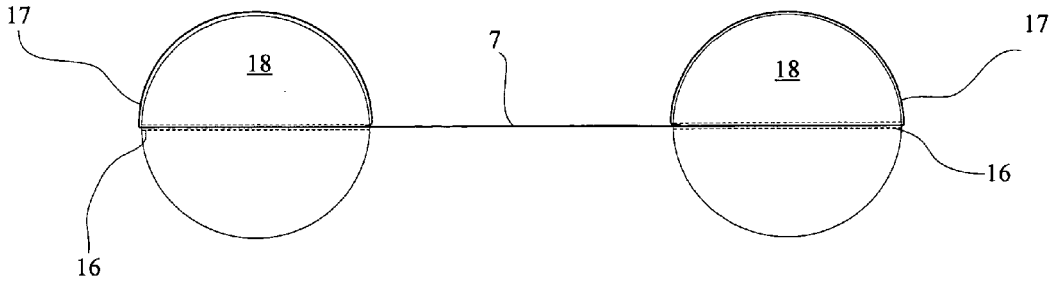
Figure 9:
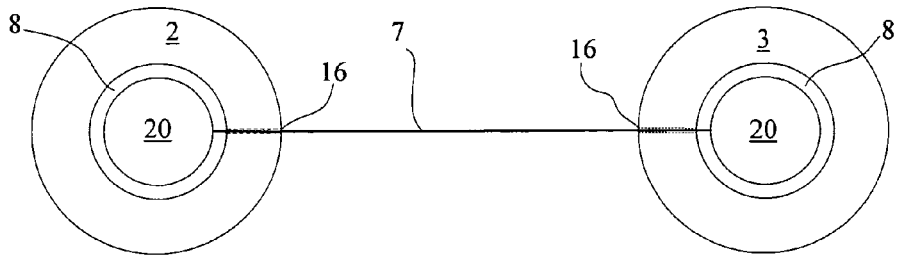
FIG. 9 illustrates another releasable connection means that can be used in the device of the invention.

In a fifth releasable connection means, a solid (without a core) foam tube 18 is used for the elongate portions. A slit 16 is then cut all the way through the foam tube. A piece of material (either non-slip or otherwise) then pushed through the solid foam tube and then the excess amount 17 is wrapped around the float tube as depicted in FIG. 8A. Where a non-slip material is used, the material is just can be wrapped around the tube or inserted into another slit. Where another material is used, a slit is not required for the releasable connection, but is helpful to prevent the extra material from flapping around. In another aspect of the invention, the piece of material is pushed through the foam tube and then the excess amount 17 is wrapped around the float tube and inserted back into the other side of the same slit as depicted in FIG. 8B A sixth releasable connection means can also be used in the invention as depicted in FIG. 9. In this aspect of the invention, a single piece of material (either non-slip or otherwise) is permanently attached to two separate members 20. The members are selected to be smaller than the hollow cores 8 of the float tubes. Each float tube is slit on its inner side in the longitudinal direction, preferably in the lower part of the inner side. The two separate members 20 are then inserted in the hollow cores of the float tubes with the piece of material fitting within the slits that have been created. Since the members 20 are only slightly smaller than the core 8, the members 20 can slide within the float tubes when not in operation and the piece of material slides with them along the slit 16. The end of the foam tubes can then be closed or sealed so that the members 20 do not slide out the end.

Figure 10:
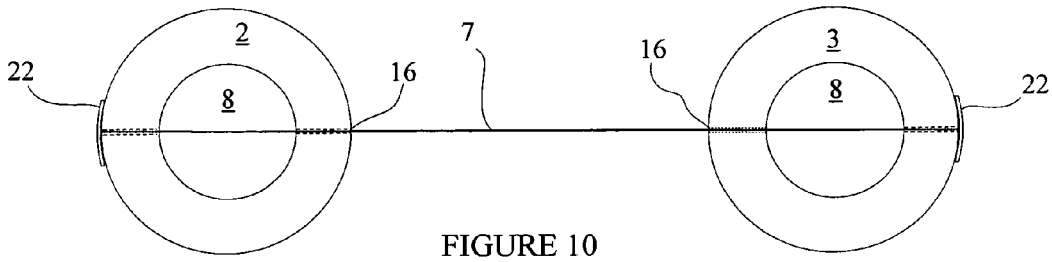
FIG. 10 depicts another releasable connection means that can be used in the device of the invention.
Figure 11:
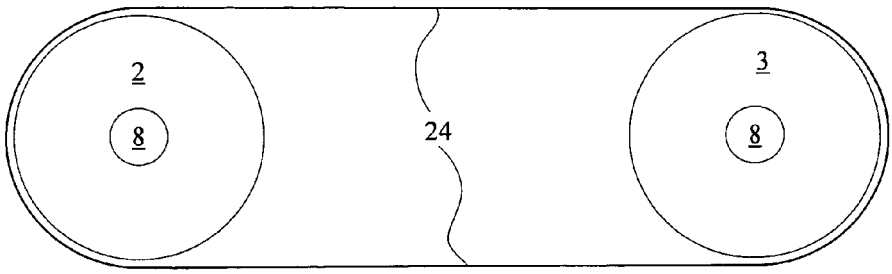
FIG. 11 shows another releasable connection means that can be used in the device of the invention.

The seventh releasable connection means is similar to the sixth means and is depicted in FIG. 10. In this aspect of the invention, however the slits 16 are also created in outer side of the foam tubes. The piece of material is also longer. Rather than members 20, the piece of material is attached to two friction means 22. The two friction means 22 with the connected piece of material is then inserted into the slits 16 such that the piece of material slides through the foam tube with the friction means 22 resting against the surface on the outer sides of the float tubes. The sling is moved by pulling the friction members 22 away from the surface of the float tubes and moving the friction members 22 in the longitudinal direction. The piece of material creating the sling moves with friction members. The sling is kept in place by the friction created between the friction members and the float tubes as well as the friction with the slit.

The eighth releasable connection means is simpler than the others. In this aspect of the invention, a single piece of material is formed into a loop 24 by connecting the ends to each other. The loop is then slipped over the outside of the float tubes. The loop 24 can be easily moved, but sometimes can slip during certain uses of the device. The loop 24 could be supplemented with, for example, drawstrings to enhance the connection to the float tube.

Any of the connection means, including the sleeve, can be supplemented or enhanced with fixation means. The fixation means comprises a discontinuity in the surface of the elongate portion. Where the surface of the elongate portion comprises a non-smooth surface (such as from a polygonal shape), the surface itself could serve as the discontinuity. The discontinuity could be a slot, slit, or notch of any shape (rectangular, square, triangular, . . . ) that is created in the surface of the elongate portion by any known means. The discontinuity acts as a fixation means by causing any portion of the connection means near it to "catch" and, to a degree, be retained.

The device 1 also contains an optional handle for the hands/arms. The handle provides a mechanism for which the person can grasp the device (if the person decides not to grasp the elongate portions). When the user grasps the handle, it permits additional advantages when using the device for instructional swimming. The handle can be located at any desired portion of the elongate portions, but usually is located near the forward end at or near the apex.

The handle can be any size/shape and made of any material that will allow a user to hold on or to grasp the device. The handle can have different lengths and widths for any desired end user. The handle can also be located at various angles relative to the elongate portions including the angle illustrated in the Figures. One example of a handle includes the short length of PVC pipe 9 illustrated in the Figures.

Figure 12:
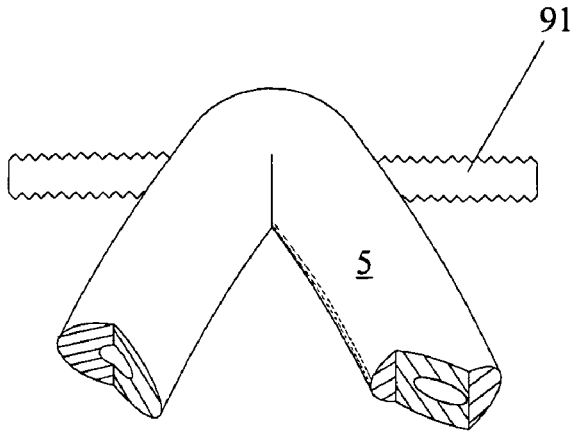
FIGS. 12-13 show handles that can be used in one aspect of the invention.

The handle can be configured to be compressible. In this aspect of the invention shown in FIG. 12, the handle 91 is configured so the user can compress the handle into the elongate portions. In this aspect of the invention, the handle is made compressible by any known means, including using a corrugated material as shown in FIG. 12. Alternatively, a part of the elongate portion could be cut out and the handle made to fold into the cut out portion, thereby "storing" the handle in the elongate portion.

Figure 13:
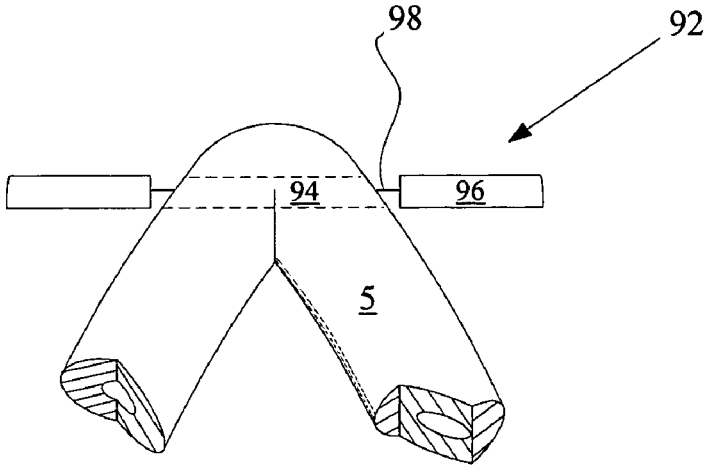

The handle can also be configured to be removable. In this aspect of the invention shown in FIG. 13, the handle 92 would comprise two portions. A first portion 94 of the handle (shown by the dashed lines) would be permanently attached to the elongate portion such that it is substantially flush with the outer surface of the float tube. A second portion 96 of the handle would then be made to be removably connected to the first portion. If desired, the first and second portions of the handle could be attached by a string 98 or the like to prevent loss of the second portion of the handle when it is removed from the first portion.

The device 1 can contain any other components known in the art. Examples of such components include an optional support for the head, an optional cupholder, an optional knit storage bag, and the like. Other examples of such components are described in the patents detailed above.

The device 1 can be made by any known process that will provide the structure illustrated in the Figures and described herein. In one aspect of the invention, the device 1 is made by taking a float tube made of polyethylene foam and forming the u-shape or the apex as described above. Next, the material for the supporting portion 7 is obtained and, if necessary, cut to the desired size. Then, the supporting portion 7 is attached to elongate portions 2 and 3 in the desired location using the connection means described above. When used, the handle is then made and then placed and attached to the desired locations on portions 2 and 3.

The devices of the invention can be used for many different purposes. In one aspect of the invention, they can be used as floating aids (i.e., for buoyancy) during recreational use. For example, the device could be used to support a user while floating on the back. In another example, the device could be used to support a use while floating on the front while snorkeling. In yet another example, they could be used for floating while being towed behind a watercraft.

The device of the invention could also be used as aids for exercise in the water. In this aspect of the invention, the device could be used during water aerobics. In another aspect of the invention, the device could be used in occupational therapy, such as with the handicapped or disabled. In yet another aspect of the invention, the device could be used for physical therapy, such as for rehabilitation from injuries.

The device of the invention could also be used during swimming. In this aspect of the invention, the devices can be used for competitive swimming (like a kickboard) and for instructional swimming (i.e., helping teach students how to float either on the stomach or on the back). In this aspect of the invention, the user can use the device on the stomach (i.e., like a kickboard), on the back (i.e., while learning how to float, kick, and/or swim), or on the side (i.e., during sidestroke). In all of these aspects, the device allows the user to place the face in the water.

In one aspect of the invention, the device can be made as a single unit. In this aspect of the invention, the device can be made as a single piece, such as using buoyant materials commonly used in kickboards. In another aspect of the invention, the device made of a single piece of material, such as an inflatable material.

Having described the preferred aspects of the invention, it is understood that the invention defined by the appended claims is not to be limited by particular details set forth in the above description, as many apparent variations thereof are possible without departing from the spirit or scope thereof.

I claim:

1. A flotation apparatus configured for supporting a user in a body of water, comprising:

an elongate buoyancy body comprising two elongate tubular portions joined at a common apex and having free distal ends, the tubular portions extending at an angle and being movable with respect to each other, a longitudinally extending slit formed in each of the tubular portions, each slit extending from an outer surface to an inner surface of the respective tubular portion; and a support structure releasably connected to the elongate buoyancy body, the support structure having side portions and front and rear edges, the side portions of the support structure extending through the slits of the tubular portions to be connected to the tubular portions without the use of a sleeve, the rear edge of the support structure being adjacent the free distal ends of the tubular portions, the front edge of the support structure being substantially aft of the apex so that the front edge is closer to the distal end of the tubular structure than to the apex, wherein an opening is defined by the elongate tubular portions and the front edge of the support structure.

2. The flotation apparatus of claim 1, wherein the apex comprises a cut at which the two elongate tubular portions are bonded together.

3. The flotation apparatus of claim 1, wherein the elongate tubular portions comprise foamed plastic.

4. The flotation apparatus of claim 1, further comprising a handle proximate the forward end of the apparatus.

5. The flotation apparatus of claim 1, wherein the slits are formed in the inner sides of the elongate tubular portions.

6. The flotation apparatus of claim 1, wherein the slits are formed in the upper sides of the elongate tubular portions.

7. The flotation apparatus of claim 1, wherein the slits are formed in the outer sides of the elongate tubular portions.

8. The flotation apparatus of claim 1, wherein the support structure is at least partially wrapped around the tubular portions.

9. The flotation apparatus of claim 1, wherein the support structure is not wrapped around the tubular portions.

10. The flotation apparatus of claim 1, wherein the side portions of the support structure comprise friction means for a releasable connection within the slits of the tubular portions.

11. The flotation apparatus of claim 1, wherein the forward end of the apex has a substantially pointed shape.

12. The flotation apparatus of claim 1, wherein the forward end of the apex does not have a substantially pointed shape.

13. The flotation apparatus of claim 1, further comprising extending means to adjust the length of the tubular portions.

14. The flotation apparatus of claim 13, wherein the extending means comprise coupling members for a frictional attachment with the corresponding tubular portions.

15. The flotation apparatus of claim 13, wherein the extending means comprise foamed plastic.

16. The flotation apparatus of claim 1, wherein the tubular portions have substantially circular cross section.

17. The flotation apparatus of claim 1, wherein the tubular portions have substantially elliptical cross section.

18. The flotation apparatus of claim 1, wherein the tubular portions have polygonal cross section.

* * * * *